US005707165A

United States Patent [19]

Albright

[11] Patent Number: 5,707,165

[45] Date of Patent: Jan. 13, 1998

[54] INTEGRATED FEATHER INK PEN

[76] Inventor: Kenneth Charles Albright, 30260 Olinda Trail, P.O. Box #651, Lindstrom, Minn. 55045

[21] Appl. No.: 691,840

[22] Filed: Aug. 1, 1996

[51] Int. Cl.[6] ..... B43K 5/00; B43K 5/18

[52] U.S. Cl. ..... 401/221; 401/6; 401/88; 401/224; D19/42

[58] Field of Search ..... D19/42; 15/435, 15/445, 444; 401/6, 224, 88, 221

[56] References Cited

U.S. PATENT DOCUMENTS

| | | | |
|---|---|---|---|
| 2,877 | 12/1842 | Alden . | |
| 11,421 | 8/1854 | Glover . | |
| 16,496 | 1/1857 | Reeve . | |
| D. 22,264 | 3/1893 | Lydick | D19/42 |
| D. 58,431 | 7/1921 | Fish | D19/42 |
| 140,771 | 7/1873 | Goodyear | 401/224 |
| 271,107 | 1/1883 | O'Donnell | 15/444 |
| D. 338,915 | 8/1993 | Willat | 401/60 R |
| 348,395 | 8/1886 | Hildebrand . | |
| 359,702 | 3/1887 | Wood . | |
| 659,925 | 10/1900 | Hooker . | |
| 659,989 | 10/1900 | Salisbury . | |
| 715,359 | 12/1902 | Dickie | 401/224 |
| 768,985 | 8/1904 | Goldsmith | 15/444 |
| 808,272 | 12/1905 | Chubb . | |
| 827,393 | 7/1906 | Schuchmann . | |
| 885,317 | 4/1908 | Bodmer | D19/42 |
| 929,172 | 7/1909 | Soulé . | |
| 1,147,511 | 7/1915 | Kayser . | |
| 1,177,828 | 4/1916 | Sprankle | 15/444 |
| 1,341,847 | 6/1920 | Griffith . | |
| 1,880,080 | 9/1932 | Felser | 15/435 X |
| 2,782,764 | 2/1957 | Lehman, Jr. | 120/102 |
| 3,933,965 | 1/1976 | Gallone et al. | 264/177 |
| 5,082,385 | 1/1992 | Stewart et al. | 401/88 |

FOREIGN PATENT DOCUMENTS

| | | | |
|---|---|---|---|
| 12890 | 6/1896 | United Kingdom | 15/444 |

OTHER PUBLICATIONS

*The World Book Encyclopedia*, "Pen", vol. 15, p. 208–209, copyright 1978.

*The Calligrapher's Handbook*, Edited by Heather Child, Taplinger Publishing Co., N.Y. 1986, pp. 211, ix, 3, 6–9, 15–16, 26–27, 29, 32–33, and 209.

*Encyclopedia Americana*, International Edition, 1995, 100th Anniversary Library Edition, "Pen", vol. 21, pp. 619–620.

*The New Encyclopedia Britannica*, "Pen Drawing", vol. 9, Edition 1994, p. 253.

*Primary Examiner*—Steven A. Bratlie

*Attorney, Agent, or Firm*—Merchant, Gould, Smith, Edell, Welter & Schmidt, P.A.

[57] ABSTRACT

An integrated feather ink pen enables one to enjoy all of the benefits of the historic form of writing without the disadvantages. A shaped grip provides a comfortable means of operating the pen. A feather is attached to the grip to provide balance and a reservoir for ink or a compartment for an ink cartridge. The grip, together with an ink transport mechanism, serve to bind the nib to the feather. The ink transport mechanism is an ink feeder tube or a fibrous filament. Alternatively, the nib is dipped in ink.

10 Claims, 2 Drawing Sheets

INTEGRATED FEATHER INK PEN

FIELD OF THE INVENTION

The present invention relates to a writing instrument known as a pen which includes the quill pen, dip pen, and fountain pen. In particular the invention is a new, composite embodiment of the varied component parts of the quill pen, dip-pen, and fountain pen which results in a new, improved, and useful, integrated feather ink pen.

BACKGROUND OF THE INVENTION

The Encyclopedia Americana, International Edition 1995, 100th Anniversary Library Edition, Volume 21, page 619 reports that the quill pen has come to us as man's principal writing instrument from 600 A.D. to 1830 A.D., some thirteen hundred years, yet to the present day the quill pen has basically remained unchanged as a writing instrument. Likewise the disadvantages, such as requiring frequent recutting, sharpening or mending of its nib, and tempering of the quill's nib, still remain as obstacles to its widespread usage. Favorable components of the feather quill pen include: its plumage of parallel barbs provide an attractive historical appearance; its long barbed shaft provides the unique feel of "feather wind" and a sense of light balance, stability, and leverage to the fingers as they manipulate the pen; its hollow barrel provides a perfect natural cavity to serve as an ink reservoir; and the natural and environmentally compatible composition of the feather functioning as the pen body, barrel, and reservoir cavity. What is needed is a writing instrument which retains the positive aspects of the quill pen while minimizing the limitations imposed by the nib.

The dip pen became the successor to the quill pen by providing a durable metal nib. There are two favorable components of the metal-nib dip pen. The gentle, comfortable shape of the grip area where the fingers hold the pen is far superior to squeezing the narrow shaft of a feather. In addition, a metal nib provides a long lasting and durable pen point. However the need to repeatedly dip the nib in an ink supply after writing only a few words remains a problem for the dip-pen. Several attempts have been made to resolve this problem by providing an attached or integral ink reservoir to the nib. In particular U.S. Pat. No. 359,702, entitled "Pen Fountain" and issued to Wood, discloses a reservoir attached to the underside of the nib. The reservoir described by Wood is conical in shape, flat on the side facing the nib. The flat side longitudinally transverses the concave under side of the nib, beginning ⅛" from the tip of the nib and continuing into the pen holder. There is a sluice or slot in the flat side of the reservoir which faces the nib. This slot tapers to a point where its margins come in contact, while at its upper end, the slot is about ⅛" wide, with deeply serrated edges traversing its length. An absorbent material occupies the interior hollow of the conical reservoir and is allowed to protrude through the slot, so as to come in actual contact with the concave surface of the nib. It is evident, however, that if too much pressure is placed on the nib point while writing, either the slit in the nib spreads apart or the nib separates from the absorbent material, or both. The effect in either case will cause ink to run out the expanded opening and onto the writing paper in an unsightly pool. This and other problems, such as clogging or starving the nib, and the unnatural, awkward shape and appearance of the pen which acts to unduly limit the insertion of the pen into a desk holder, are common hindrances in the use of the dip pen with attached and integral reservoirs. There remains a need for a writing instrument which provides a steady flow of ink to the paper in spite of uneven usage. In addition potential users need a design which is more comfortable to use and is compatible with a variety of personal writing styles.

The fountain pen with its integral system of supplying ink to the nib from a cartridge reservoir in the barrel of the pen holder is a further attempt to overcome the aforementioned problems of the dip and quill pens. The fountain pen adds the feature of a feed, pierce tube and ink cartridge assembly unit which supplies a trouble-free flow of ink to the nib. Nevertheless, the fountain pen has other deficiencies. One general drawback of the fountain pen is that it is much larger in diameter in order to accommodate the ink cartridge. This makes it difficult to comfortably hold and use the fountain pen. In addition, the body, barrel, and finger gripping pen holder area, which comprise the major portion of the fountain pen, are fabricated with synthetic materials. There remains a need for a writing instrument which contains a reservoir of ink to enable writing for extended periods of time, the writing instrument being of a form which fits comfortably in the hand, responds equally well to a variety of writing styles, and of a physical presentation which is fitting in light of the pen's prominent role in pivotal events over the course of human history, while being environmentally friendly.

A writing instrument is more than simply a means enabling the physical representation of thoughts and words. The second edition of Calligrapher's Handbook, published in the United States in 1986 by Taplinger Publishing Co. Inc. N.Y. N.Y., and edited by Heather Child on behalf of The Society of Scribes and Illuminators, states that there is a relationship between handwriting and personal development. For example, on page 203 it states: "[W]riting . . . is so related to an individual that it has a special value to him and his friends, and in business transactions, as an expression of personality, and this quite apart from its function as a means of communicating, recording, and remembering. A person may write . . . so that . . . his writing ranges from something that all can read to a scribble which he himself finds illegible; yet his varying handwriting could always be identified as his own." On pages 211–12, the Handbook notes: "[T]here is a period in our lives when handwriting plays an important role in our development and that is during the formative years of our education. . . . [T]he way we write is an integral part of our personality . . . . A number of respected studies of Primary Education (4.5 to 12 years) such as the Plowden and Bullock Reports have seen fit to mention the supportive role that a good style of handwriting can make during the formative years of school training."

Thus, it is believed that a relationship exists between the use of an ink pen to write with and the identity and development of the penperson, and that this relationship is especially at work during the formative years of life. However, as each successive handwriting instrument was invented, it replaced the popular use of the prior instrument; from the quill pen, to the metal nib dip-pen, to the fountain pen, to the ballpoint pen, and currently it is being replaced by the word-processor and computer. This being true, a significant problem emerges by the decline in the use of the pen as a writing instrument, to wit, that with this decline has come the loss of a good tool in the hands of a teacher to guide the development of school children during their primary years of education.

Furthermore, the feather pen's profile is a common symbol for sagacious literature. Its silhouette is conspicuously illustrated at the beginning of all kinds of literary publications. The significance of this symbol is derived from the feather or quill pen's usage in association with historically sagacious writings, such as the Declaration of Independence, the Bill of Rights, and the Emancipation Proclamation. This powerful symbol has been artfully used in marketing millions of pieces of literature, books, pamphlets, articles, and publications of every kind, but today the living aspect of this symbol is dying as illustrated by biographer Doris Kearns Goodwin, who until now has written all her books in longhand, including her Pulitzer Prize-winning biography of Franklin and Eleanor Roosevelt, but has now indicated her intent to change to the computer. The problem is that in losing the "life" of a symbol that has represented mankind's instrument for writing over the past thirteen hundred years is to lose a contemporary force to motivate and inspire creative interaction with historic ideas.

SUMMARY OF THE INVENTION

It is a primary purpose of this invention to make an integrated feather ink pen which will be similar in form and shape, and true to the historical mode and usage, of the quill pen and dip-pen, yet new and improved in it's usefulness and function. One advantage of the invention is that one whose sentiments are inclined toward experiencing history can enjoy all of the benefits of the historic form of writing without the disadvantages.

In keeping with this historical focus it is the object of the invention to configure the useable and favorable components of the quill pen and dip-pen in concert with an improved method and apparatus for retaining and delivering ink via the integrated feather ink pen to a writing surface. The integrated feather ink pen eliminates the specific problems inherent in conventional liquid ink writing instruments.

One embodiment of the present invention is a pen, including a feather, an ink transport assembly removably attached to the feather, a nib removably attached to the ink transport assembly, and a grip having an opening running longitudinally through the center of the grip. The feather and the nib are attached at opposite ends of the opening through friction, and the ink transport assembly is contained within the opening in the grip.

Another embodiment of the invention is a pen including a feather having a hollow shaft which is open at one end, a fibrous filament, a nib, and a grip having an opening running longitudinally through the center of the grip. The feather and the nib are attached to the grip at opposite ends of the opening through friction. The fibrous filament is contained within the opening of the grip such that one end is inserted into the shaft of the feather and the opposite end is in contact with the nib.

Yet another embodiment of the invention is a pen including a feather having a hollow shaft which is open at one end, a nib, a grip having an opening running longitudinally through the center of the grip, and a feather retainer for firmly attaching the feather to the grip. The feather and the nib are attached to the grip at opposite ends of the opening through friction.

A further advantage of the invention is that its historical influence as a powerful living symbol may be used by teachers to motivate and inspire young children in their personal development, during their formative years of education. The integrated feather ink pen may be used as an aid for educators in teaching from a historical perspective personal and social values. One method is by the exercise referred to as "Text Copy" where penmanship, and personality enrichment are enhanced by hand copying historic documents such as those previously cited in the Background to the Invention. The advantage is to impact the life of the pen-person through the eye, hand, ear, mind, and heart gate. Such use of the new feather ink pen, as a living historical symbol, combined with a good teaching method and with appropriately coordinated curriculum will serve as an aid to student endeavor. This effort will provide the opportunity to mature the personality, ennoble the character, and inspire basic virtues of integrity and justice in the hearts and minds of students, as they move toward personal and social responsibility.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and design changes may be made without departing from the spirit and scope of the present invention. The following detailed description is, therefore, not to be taken in a limiting sense, and the scope of the present invention is defined by the appended claims.

Figure 1:
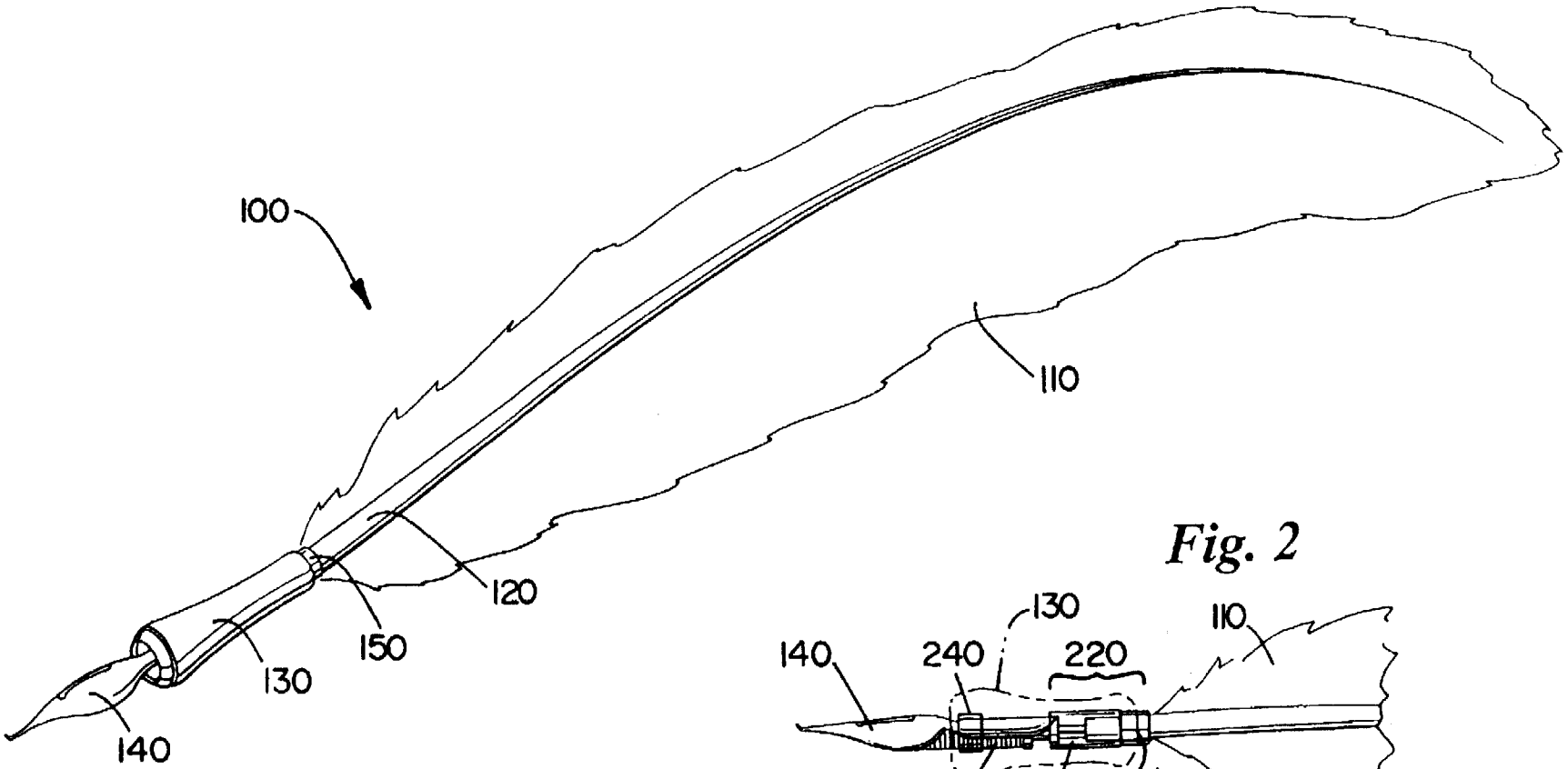
FIG. 1 is a perspective view of one embodiment of a fully assembled integrated feather ink pen made according to the present invention.

FIG. 1 shows a completely assembled integrated feather ink pen 100 according to one embodiment of the present invention. The pen includes a feather 110 (which has a barrel 120), a grip 130, a nib 140, and a feather retainer 150.

The person using the pen holds it by the grip 130, which is formed to comfortably fit the human hand. Different sizes and shapes of grip are anticipated to meet the needs of a wide variety of hand sizes and gripping styles (how the user actually holds the writing instrument). In the preferred embodiment grip 130 is formed from wood, but alternate embodiments may employ clay, glass, ceramics, pewter, or any suitable material. The shape of grip 130 is that of a pear, preferably measuring 5/16" to 3/8" in diameter at the top slender end, and approximately 1/2" in diameter at the bulge bottom end. The length is approximately 1 1/4". A hole completely transverses longitudinally the center of grip 130.

At the top end of the grip the hole is custom sized to fit the diameter of the feather's reservoir (220 in FIG. 2), 10 which slides into the top of the grip and is held in position by friction. Feather retainer 150 is a band which fits around the reservoir 220 and provides a tight seal for inserting the feather in the grip as well as a protection from splitting grip 130. Feather retainer 150, in the embodiment shown, is constructed of polished brass, but a variety of materials, including but not limited to aluminum, stainless steel, or plastic may be used without departing from the spirit and scope of the present invention. The opposite end of the hole, at the bottom of the grip, is custom sized to fit the shank of nib 140 and ink transport assembly 250.

A feature of the present invention not heretofore employed in conventional liquid ink writing instruments is the use of grip 130 with feather retainer 150 to improve the utility of the feather. While the feather's barrel 120 provides balance, control, and leverage, its small diameter is ill-fitted for human fingers to maintain a good grip. The problem that the penwriter encounters by using a conventional quill is that the fingers begin to slide down the barrel of the quill. To compensate the fingers are forced to squeeze tighter, which in time produces muscle fatigue and cramps. The larger diameter and shape of grip 130 solves this problem, thereby reducing the need for the fingers to squeeze so intensely and thereby reducing fatigue. A second improvement that the grip makes on the utility of the feather quill pen is in the design of the grip. The grip is shaped with a bulge at one end that gently slopes to the finger gripping area, where a cross hatched or similar engraving (not shown) is preferably provided on the grip. This cross hatched engraving covers the area for gripping and gives a marked improvement to the secure maneuverability, comfort, and control of the integrated feather ink pen as a writing instrument.

Figure 2:
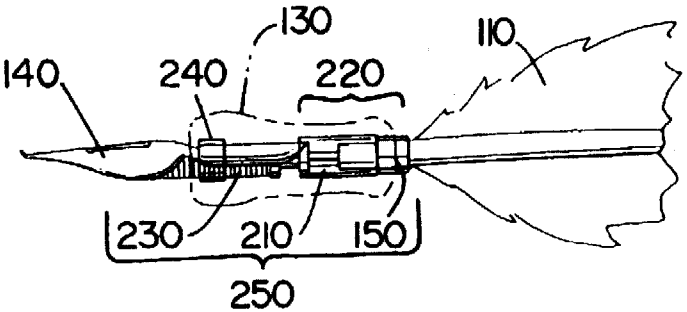
FIG. 2 is a side view of the embodiment shown in FIG. 1, partially cut away to illustrate the internal structure thereof.

FIG. 2 further illustrates the internal elements of one embodiment of the present invention as they relate when fully assembled. Grip 130 serves to bind the other elements together into a unitary whole. Feather retainer 150 holds feather 110 firmly in grip 130. An ink transport mechanism 250 is located within grip 130, and is made up of ink feeder tube 230, upper coupling 210 and lower coupling 240. Upper plastic coupling 210 fits snugly over the end of feather reservoir 220 and inside the hole transversing grip 130. Coupling 210 serves primarily to attach ink feeder tube 230 to the feather reservoir 220 in order to facilitate ink transport from the reservoir to nib 140. Coupling 210 also serves as a retainer, holding the ink transport assembly 250 firmly within the center of grip 130. Lower plastic coupling 240 serves primarily to bind ink feeder tube 230 to nib 140 in the proper relationship and in the center of grip 130 so that ink properly transfers from ink feeder tube 230 to nib 140 and from there to the writing surface in a smooth, even flow. Upper and lower plastic couplings 210, 240 are constructed of flexible plastic tubing with an outer diameter essentially equal to the diameter of the hole transversing grip 130.

The result of this configuration of these component parts is an operational integrated feather ink pen. The advantage of holding feather 110 and nib 140 with the ink transport assembly 250 unit in grip 130 by friction enables them to be quickly removed from grip 130 and replaced by simply pulling them out and pushing a new one in. This friction feature also enables nib 130, reservoir 220, and feather 110 components to be similarly disassembled, cleaned in a unencumbered manner, and then reassembled.

Figure 3:
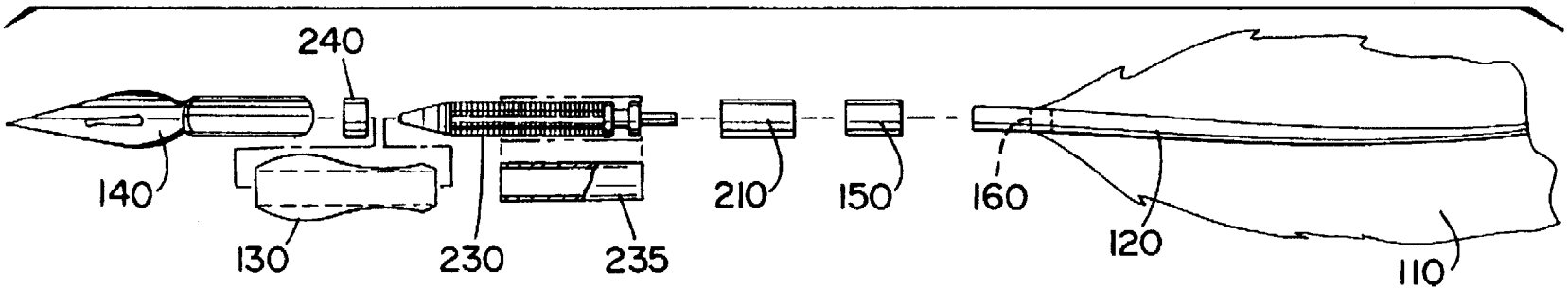
FIG. 3 is an exploded schematic diagram of a second embodiment of an integrated feather ink pen made according to the present invention.

Feather 110 serves as the pen body, providing the necessary amount of balance for comfortable writing and for maintaining the appropriate angle of the pen in relationship to the writing surface. The barrel of the feather 120, when inserted in grip 130, supports the pen body. From the point the shaft extends beyond the feather barbs the shaft is hollow and is referred to as the reservoir 220. In the embodiment of FIGS. 1–2, reservoir 220 serves as the ink reservoir, the ink feeder tube 230 protruding sufficiently far into reservoir 220 to draw ink down to nib 140. In the alternative embodiment shown in FIG. 3, the ink transport assembly further comprises a sleeve 235 which encases the ink feeder tube 230, enhancing air flow into the reservoir and improving ink flow by capillary action. Sleeve 235 is constructed of plastic or other ink and air impermeable material, with an inner diameter just large enough to fit snugly around ink feeder tube 230, and an outer diameter roughly equivalent to the inner diameter of coupling 210.

The upper end of reservoir 220, where it meets the feather barrel 120, may be sealed with glue 160 or a similar substance to prevent ink leaching out through the feather's barbs. Reservoir 220 is filled with ink prior to attaching it to the ink transport assembly 250 mounted in grip 130. Nib 140 is attached to the ink transport assembly using lower plastic coupling 240 as described previously. In another embodiment, a pierce tube and replaceable ink cartridge assembly unit (not shown) may be inserted in reservoir 220 in lieu of filling the reservoir 220 with ink.

Figure 4:
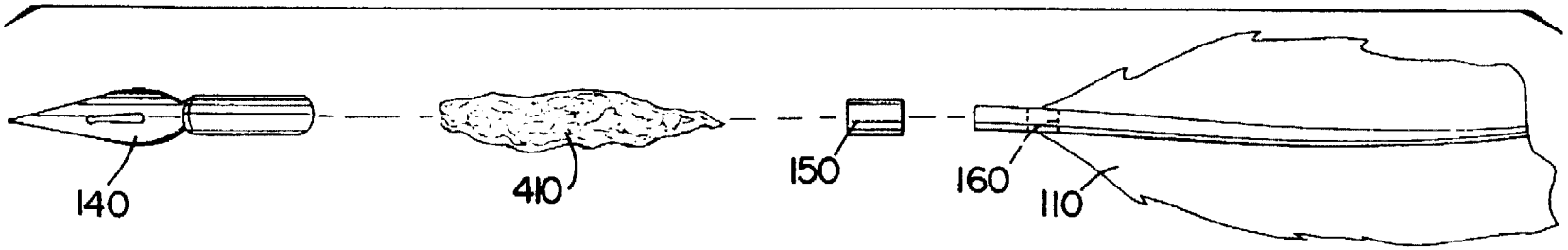
FIG. 4 is an exploded schematic diagram of a third embodiment of an integrated feather ink pen made according to the present invention.

In a further embodiment of the present invention, the above cited feed, pierce tube, and ink cartridge assembly unit is replaced with a fibrous filament, as shown in FIG. 4. In this configuration the fibrous filament 410 becomes the onboard reservoir material. Dacron is a preferred material for the fibrous filament. Other materials such as polyester fibers or coarse wool may be used as well without departing from the spirit and scope of the present invention. In this embodiment, metal feather retainer 150 is mounted in upper opening of grip 130, the feather 110 is inserted into grip 130 (not shown in FIG. 4). Fibrous filament 410 is inserted through the other end of grip 130 followed by the upper end of nib 140. A fibrous reservoir is disposable, less expensive and may be charged with ink by dipping or feeding the reservoir with an eye dropper to provide a very substantial ink supply to the nib 140.

Figure 5:
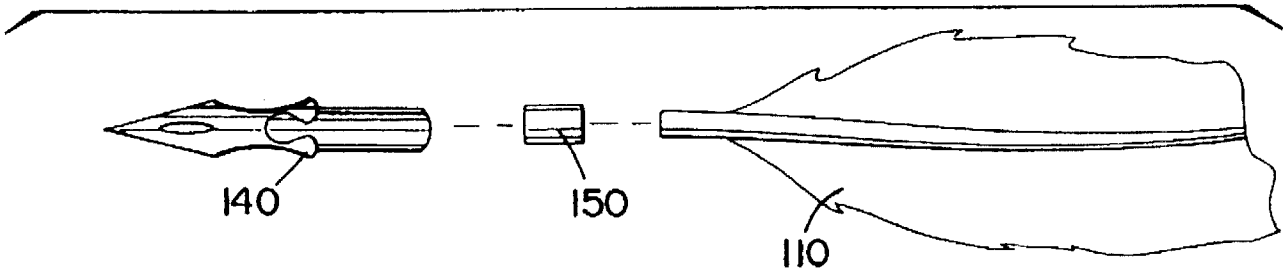
FIG. 5 is an exploded schematic diagram of a fourth embodiment of an integrated feather ink pen made according to the present invention.

FIG. 5 shows yet another embodiment of the present invention. In this embodiment there is no ink reservoir or ink transport assembly. According to this embodiment feather 110 is inserted into metal feather retainer 150 in order to facilitate a firm attachment with grip 130 (not shown in FIG. 5). Nib 140 is inserted in the other end of grip 130. The user prepares for writing with the resulting pen by dipping nib 130 in an ink supply.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A pen comprising a feather having a hollow shaft at one end to define an ink reservoir, an ink transport assembly having an ink feeder tube coupled to the ink reservoir, a nib removably attached to the ink transport assembly, a grip having an opening that extends longitudinally through the center of the grip, and a feather retainer coupled to the grip, wherein the feather and the nib are frictionally engagable to opposite ends of the opening, and the ink transport assembly is contained within the opening in the grip, and wherein the feather retainer functions to seal the feather to the grip.

2. The pen of claim 1, further comprising an end plug contained within the shaft, wherein the ink reservoir is defined by the shaft and the end plug.

3. The pen of claim 2, wherein the ink transport assembly further comprises an upper coupling which attaches the ink feeder tube to the shaft of the feather, and a lower coupling which attaches the ink feeder tube to the nib.

4. The pen of claim 3, wherein the upper and lower coupling are short sections of plastic tubing.

5. The pen of claim 3, wherein the ink transport assembly further comprises a sleeve which encases the ink feeder tube, one end of said sleeve being attached to the upper coupling.

6. The pen of claim 2, wherein the grip is generally pear-shaped and includes upper, middle, and lower sections, each having an outer diameter, wherein the outer diameter of the upper section is greater than that of the middle section, and wherein the outer diameter of the lower section is greater than that of the upper section.

7. A pen, comprising a feather having a hollow shaft at one end to define an ink reservoir, a fibrous filament, a nib, a grip having an opening that extends longitudinally through the center of the grip, and a feather retainer coupled to the grip, wherein the feather and the nib are frictionally engagable to the grip at opposite ends of the opening and the fibrous filament is contained within the opening of the grip such that one end is inserted into the ink reservoir within the shaft of the feather and an opposing end is in contact with the nib, and wherein the retainer functions to the seal the feather to the grip.

8. The pen of claim 7, further comprising said feather retainer for firmly attaching the feather to the grip.

9. The pen of claim 7, wherein the grip is generally pear-shaped and includes upper, middle, and lower sections, each having an outer diameter, wherein the outer diameter of the upper section is greater than that of the middle section, and wherein the outer diameter of the lower section is greater than that of the upper section.

10. The pen of claim 7, further comprising an end plug contained within the shaft, wherein the ink reservoir is defined by the shaft and the end plug.

* * * * *